US007469554B2

(12) United States Patent
Martins et al.

(10) Patent No.: US 7,469,554 B2
(45) Date of Patent: Dec. 30, 2008

(54) CONDENSER, IN PARTICULAR FOR A MOTOR VEHICLE AIR CONDITIONING CIRCUIT, AND CIRCUIT COMPRISING SAME

(75) Inventors: Carlos Martins, Le Chesnay (FR); Jerome Genoist, Versailles (FR); Jacques Hoffnung, L'ile Saint Denis (FR)

(73) Assignee: Valeo Systeme Thermiques, Le Mesnil Saint Denis ( * ) Notice: Subject to any disclaimer, the term of this patent is extended or adjusted under 35 U.S.C. 154(b) by 17 days.

(21) Appl. No.: 10/532,513

(22) PCT Filed: Oct. 31, 2003

(86) PCT No.: PCT/FR03/03055

§ 371 (c)(1),
(2), (4) Date: Apr. 25, 2005

(87) PCT Pub. No.: WO2004/042293

PCT Pub. Date: May 21, 2004

(65) Prior Publication Data

US 2006/0053833 A1 Mar. 16, 2006

(30) Foreign Application Priority Data

Oct. 31, 2002 (FR) ..... 02 13671

(51) Int. Cl.
*F25B 39/04* (2006.01)

(52) U.S. Cl. ..... 62/506; 165/140; 165/167

(58) Field of Classification Search ..... 62/506–507, 62/509; 165/152–153, 140, 167
See application file for complete search history.

(56) References Cited

U.S. PATENT DOCUMENTS

| | | | | | |
|---|---|---|---|---|---|
| 4,274,482 | A * | 6/1981 | Sonoda | 165/153 |
| 4,592,414 | A * | 6/1986 | Beasley | 165/76 |
| 5,129,449 | A | 7/1992 | Nguyen | |
| 5,628,206 | A * | 5/1997 | Baba | 62/507 |
| 5,720,341 | A * | 2/1998 | Watanabe et al. | 165/135 |
| 5,901,573 | A * | 5/1999 | Kobayashi | 62/507 |
| 5,918,664 | A * | 7/1999 | Torigoe | 165/78 |
| 6,142,221 | A * | 11/2000 | Johansson | 165/140 |
| 6,340,053 | B1 * | 1/2002 | Wu et al. | 165/167 |
| 6,948,559 | B2 * | 9/2005 | Reinke et al. | 165/140 |
| 2002/0056546 | A1 * | 5/2002 | Judge et al. | 165/96 |
| 2003/0010483 | A1 * | 1/2003 | Ikezaki et al. | 165/174 |

FOREIGN PATENT DOCUMENTS

| | | | |
|---|---|---|---|
| BE | 350 706 | A | 7/1928 |
| DE | 296 22 191 | U | 2/1997 |
| EP | 0 292 245 | A | 11/1988 |
| EP | 1 054 225 | A | 11/2000 |
| EP | 1 063 486 | A | 12/2000 |
| FR | 2 808 869 | A | 11/2001 |
| JP | 10 267427 | A | 10/1998 |
| JP | 2000 258082 | | 1/2001 |
| JP | 2000 356483 | | 4/2001 |
| WO | WO 01/88454 | A | 11/2001 |

* cited by examiner

*Primary Examiner*—William E Tapolcai
(74) *Attorney, Agent, or Firm*—Howard & Howard Attorneys, P.C.

(57) ABSTRACT

The invention concerns a condenser consisting of stacked plates (2) provided each with a raised peripheral edge (3) in sealed assembly to define flow channels between the plates for a refrigerating fluid (F1) and a cooling fluid (F2). The plates comprise communicating passageways (124) for the passage of the refrigerating fluid and the cooling fluid from one flow channel to the other. Annular ducts (122) are provided opposite the communicating passageways to prevent the fluids from being mixed. A bottle (100) is interposed between a cooling section (94) and sub-cooling section (96). The invention is applicable to motor vehicles.

32 Claims, 10 Drawing Sheets

CONDENSER, IN PARTICULAR FOR A MOTOR VEHICLE AIR CONDITIONING CIRCUIT, AND CIRCUIT COMPRISING SAME

The invention relates to motor vehicle air-conditioning circuits.

Modern motor vehicles are often equipped with a circuit for air-conditioning their cabin. These circuits particularly comprise a condenser, through which an air-conditioning fluid in the gaseous state is cooled in order to condense it.

In this field it is also known practice to use air-conditioning fluids, such as $CO_2$, on which the circuit can operate without the fluid changing phase. The circuit is then equipped with a heat exchanger able to lower their temperature, without, however, going so far as to condense them.

The invention is as applicable to an actual condenser proper as it is to such exchangers. In order not to make the remainder of the text overly unwieldy, only the term condenser will be used. Nonetheless, it is to be understood that this term covers both a heat exchanger intended to allow a fluid to be condensed and a heat exchanger intended simply to allow the fluid of a motor vehicle air conditioning circuit to be cooled.

Currently known condensers generally consist of a bundle of tubes, the tubes being connected at each of their ends to header boxes. The tubes are equipped with heat-exchange surfaces such as pins or corrugated inserts. They are cooled by exchanging heat with the atmospheric air and, for this purpose, are placed at the front of the motor vehicle, generally in front of the engine cooling circuit radiator.

These known condensers exhibit several disadvantages. They are not able to exchange heat with the water in the engine cooling circuit. Their side-to-side area, and therefore their size, are great. Furthermore, they have a necessity to be placed along the front face of the motor vehicle so that they can be cooled effectively.

It is also known practice to produce condensers consisting of a multitude of stacked main-section plates assembled to delimit first flow channels for a refrigerating fluid which alternate with second flow channels for a cooling fluid. A condenser of this type is described in document WO 01/88454.

Thanks to these features, a condenser such as this can be cooled by a liquid, particularly by the liquid in the engine cooling circuit. It is therefore more compact than an air-cooled condenser. There is no need to site it along the front face of the vehicle. It can therefore be placed near the evaporator, making it possible to shorten the length of pipework in the air-conditioning circuit. However, a condenser of this type also exhibits disadvantages, particularly the fact that it is unable to perform sufficient exchange of heat.

The subject of the invention is a condenser, particularly for a motor vehicle cabin air-conditioning circuit, which overcomes these disadvantages. This condenser needs to allow improved cooling of the air-conditioning circuit air-conditioning fluid by the water in the engine cooling circuit.

To this end, the invention proposes a condenser of the type defined hereinabove which comprises at least two passes over the refrigerating fluid.

The term "pass" is to be understood to mean a group or sub-group of plates between which the fluid follows one and the same direction in one and the same sense. In plates of one and the same pass, the inlet and outlet orifices are situated, in particular, at two opposite edges of said plates. On moving on from one pass to another, the sense in which the fluid circulates is reversed. It is thus possible to lengthen the path of the fluid through the exchanger. By virtue of these features, the condenser according to the invention exhibits improved performance.

The condenser is made up of a stack of main-section plates. One end plate is arranged at each of the ends of the stack of main-section plates.

The plates comprise communication passages to allow the. refrigerating fluid and the cooling fluid to pass from one flow channel to the other, annular ducts are provided alternately facing the communication passages so as to prevent fluids from mixing.

As a preference, the main-section plates are equipped with two communication passages intended for the passage of the air-conditioning fluid and with two communication passages intended for the passage of the cooling fluid. Thus, each main-section plate has, in total, four communication passages.

In one particular embodiment, the plates are equipped with turned-up peripheral edges which are joined together in a sealed manner so as to delimit the first flow channels and the second flow channels.

In another particular embodiment, the condenser comprises at least two passes over the cooling fluid.

Advantageously, the condenser comprises at least one inlet and one outlet for refrigerating fluid and at least one pass over the refrigerating fluid communicating with said inlet, known as the inlet pass, and another pass communicating with said outlet, known as the outlet pass, the cross section of the passes diminishing from the inlet pass towards the outlet pass.

In exchangers of a known type, the passes are produced either by separating partitions arranged in the header boxes in the case of tube-type exchangers, or by spacer pieces arranged between the plates of stacked-plate heat exchangers. By contrast, in the condenser of the invention, circulation passes for the fluids can be achieved without adding additional components. To achieve this, all that is required is the omission of certain communication passages made in the main-section plates. For this, one refrigerating fluid communication passage or, as appropriate, one cooling fluid communication passage, is omitted in some of the main-section plates so as to determine passes for the circulation of the refrigerating fluid or, as appropriate, for the circulation of the cooling fluid.

As already stated, in one embodiment of the invention, the cross section of the passes diminishes from the pass communicating with the inlet of the condenser, known as the inlet pass, towards the pass communicating with the outlet of said condenser, known as the outlet pass.

The condenser according to the invention may comprise at least three passes, the number of channels allocated to the inlet pass to the number of channels allocated to the outlet pass lying, for example, between 2 and 5, the cross section of the channels being designed to be constant from one channel to the other.

Advantageously, the plates of the condenser are arranged in a first series for cooling the refrigerating fluid until it condenses, and a second series for cooling the refrigerating fluid below the temperature at which it condenses (to super-cool it).

Advantageously too, the condenser of the invention comprises a bottle built in between the first and second series of plates.

In order to improve the exchange of heat between the fluids, elements which disrupt the flow, known as turbulence generators, may be provided. In one alternative form, the turbulence generators are arranged between the plates. In another alternative form, the plates themselves have reliefs which constitute turbulence generators.

As a preference, the hydraulic diameter of the circulation channels is between 0.1 mm and 3 mm. It may in particular be from 0.1 to 0.5 mm in the case of fluids intended not to change phase, except under exceptional circumstances, and from 0.5 to 3 mm in the case of fluids which are intended to be condensed. It will, for example, range from 1 to 2.6 mm for the cooling fluid, which may be water, particularly that of the cooling circuit.

Finally, the annular ducts advantageously consist of bowls formed in the plates. Manifolds are thus defined without the need to provide any additional components.

As a preference, the cooling fluid consists of the water from the motor vehicle engine cooling circuit.

Furthermore, the invention relates to an air-conditioning circuit, particularly for the cabin of a motor vehicle, comprising an evaporator, a compressor, a condenser, an expansion valve in which a refrigerating fluid circulates, in which the condenser is in accordance with the present invention.

Other features and advantages of the invention will become further apparent from reading the description which follows of some embodiments which are given by way of illustration with reference to the attached figures. In these figures.

Figure 1:
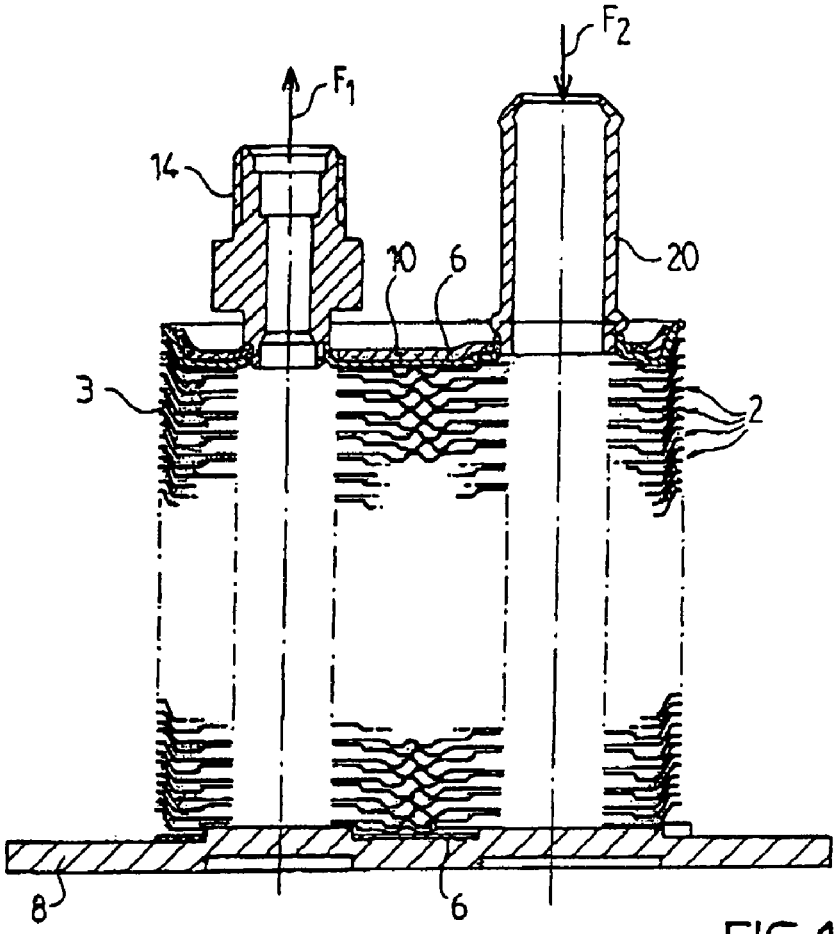
FIG. 1 is a view in section of a condenser according to the invention.

FIG. 1 depicts a cross section of a condenser according to the present invention. It comprises a multiplicity of main-section plates 2 stacked one upon the other and each equipped with a peripheral rim 3. The peripheral edges are assembled in a sealed manner so as to delimit between the plates 2 first flow channels for a refrigerating fluid F1 which alternate with second flow channels for a cooling fluid F2. The stack of main-section plates has an end plate 6 at each of its ends.

In order to enhance the pressure withstand of the condenser, the main-section plates 2 are sandwiched between a lower reinforcing plate 8 and an upper reinforcing plate 10. The refrigerating or air-conditioning fluid F1 enters the condenser via an inlet pipe (not depicted in FIG. 5) and emerges therefrom via an outlet pipe 14. The cooling fluid F2 enters the condenser via an inlet pipe 20 and emerges therefrom via an outlet pipe (not depicted). Refrigerating fluid F1 enters in the gaseous state. It circulates through the first channels, exchanging heat with the cooling fluid F2, which causes it to condense. The fluid F1 therefore leaves the condenser in the liquid state.

The refrigerating or air-conditioning fluid is, for example, the fluid R134a or R744 ($CO_2$), while the cooling fluid F2 consists of the water from the engine cooling circuit. It may also involve an independent water loop.

Figure 2:
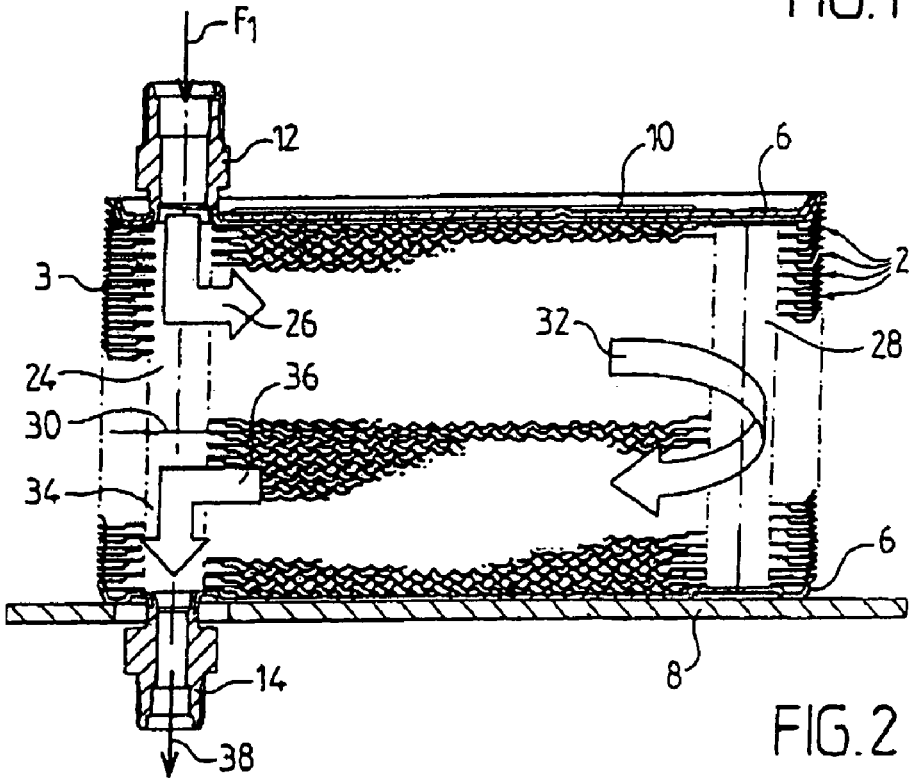
FIG. 2 is a view in section of a condenser according to the invention, comprising two passes with the refrigerating fluid.

The condenser depicted in FIG. 2 comprises two circulation passes for the air-conditioning or refrigerating fluid. This fluid enters the pipe 12 as depicted schematically by the arrow F1, it enters an annular duct 24 acting as an inlet header box and, from there, enters the first circulation channels provided between the plates 2, as depicted schematically by the arrow 26. Having covered the entire heat-exchange surface, the air-conditioning fluid reaches an annular duct 28 and, from there, enters the first circulation channels provided between the plates 2 situated below the dividing partition 30, as depicted schematically by the arrow 32. It passes through the exchanger a second time, from right to left, in a second pass, to reach the lower part 34 of the annular duct which acts as an outlet header box, as depicted schematically by the arrow 36, and leaves the condenser via the outlet pipe 14, as depicted schematically by the arrow 38.

Figure 3:
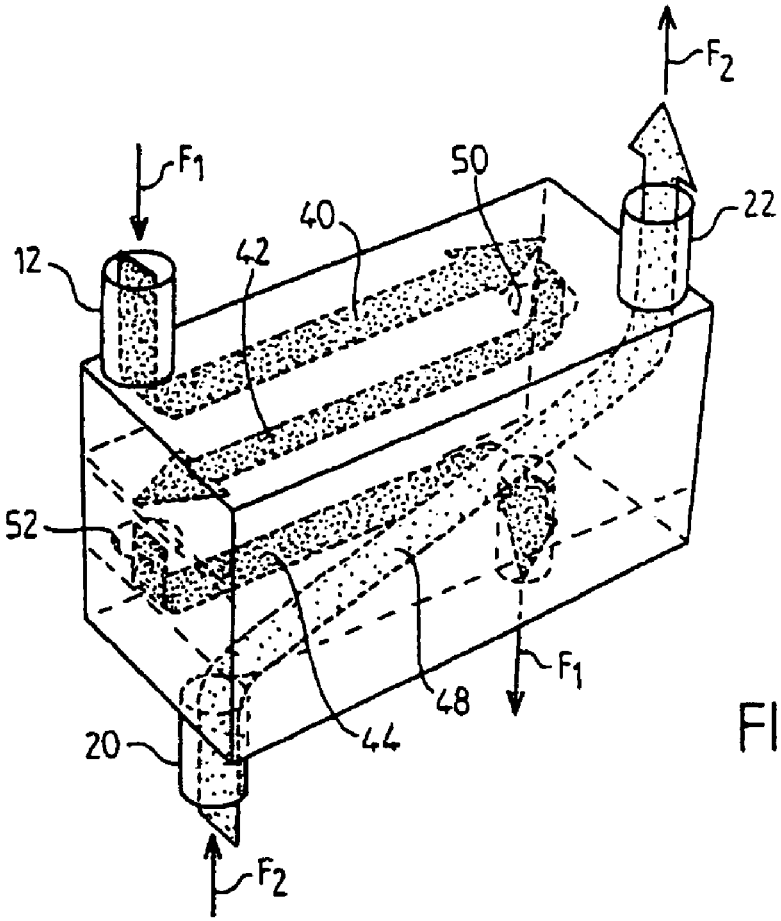
FIG. 3 is a schematic perspective view of a condenser according to the invention, comprising three passes with the refrigerating fluid and one pass with the cooling liquid.

As can be seen in FIG. 3 which depicts a perspective view of a condenser according to the invention, the refrigerating fluid F1 and the cooling fluid F2 do not necessarily travel through the condenser with the same number of passes. In the example depicted, the condenser has three passes depicted schematically by the arrows 40, 42 and 44, for the refrigerating fluid, and just one pass, depicted schematically by the arrow 48, for the cooling fluid F2. The fluid F1 moves on from the first pass to the second having crossed the passage orifice 50, then from the second pass 42 to the third pass 44 once it has crossed the communication passage 52. It reemerges from the exchanger via the outlet pipe 14. The cooling fluid F2 enters via the inlet pipe 20, and passes through the exchanger in a single pass 48 and reemerges from the condenser via the outlet pipe 22.

Figure 4:
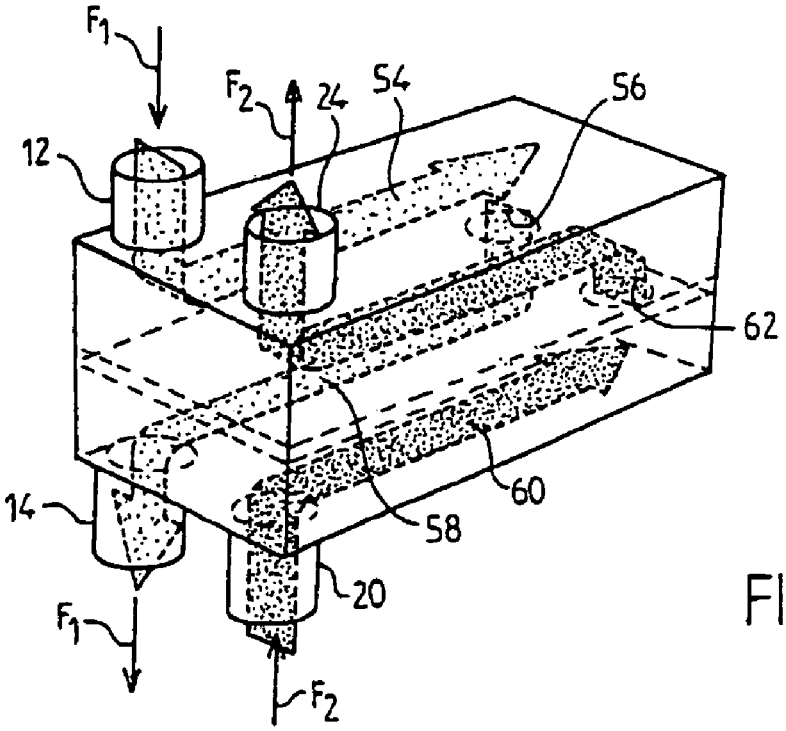
FIG. 4 is a schematic perspective view of a condenser according to the invention comprising two passes with the refrigerating fluid and two passes with the cooling liquid.

In FIG. 4, the condenser has two circulation passes for the refrigerating fluid and two passes also for the cooling fluid. The refrigerating fluid F1 enters the condenser via the inlet pipe 12, runs along the plates in its first pass 54, crosses the communication passage 56 and travels through the second pass 58 before reemerging via the outlet pipe 14. The cooling fluid F2 enters the condenser via the inlet pipe 20, runs through the first pass, as depicted schematically by the arrow 60, crosses the communication passage 62 before covering the second pass 64. It then reemerges from the exchanger via the outlet pipe 24.

Figure 5:
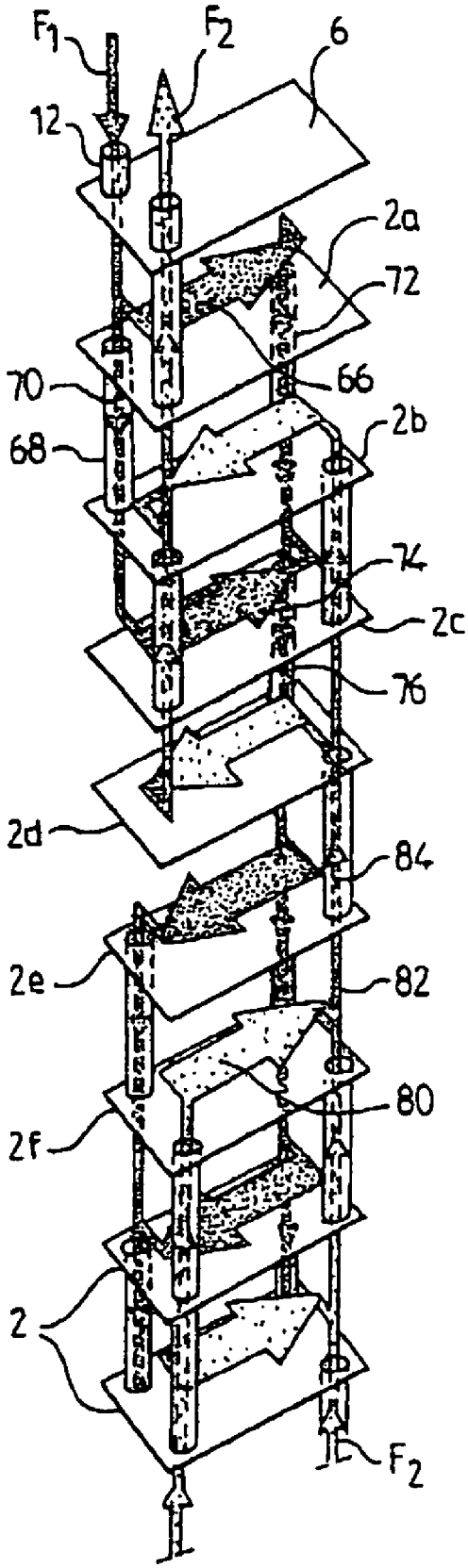
FIG. 5 is an exploded perspective view of an exchanger with two passes with the refrigerating fluid and two passes with the cooling fluid and which illustrates the circulation of these two fluids.

FIG. 5 schematically depicts an exploded perspective view which illustrates the circulation of the fluids in a condenser according to the invention comprising two circulation passes for the air-conditioning fluid F1 and two passes for the cooling fluid F2. The fluid F1 enters the upper part of the exchanger via the inlet pipe 12 into the volume delimited by the end plate 6 and the adjacent plate 2. Some of the fluid flows through this space from left to right according to FIG. 5, as depicted schematically by the arrow 66. The rest of the fluid enters an annular duct 68 arranged between the plates 2*a* and 2*b*, as depicted schematically by the arrow 70. On leaving the annular duct, it enters the space that lies between the plates 2*b* and 2*c*. The proportion of the fluid which passed through the space lying between the end plate 6 and the first main-section plate 2*a* reemerges from this space via a tubular duct 72 arranged between the plates 2*a* and 2*b*.

The flat space between the plates 2*b* and 2*c* has just one communication passage 74 allowing the fluid F2 out. This fluid passes through the annular passage 76 to arrive between the plates 2*d* and 2*e* having undergone a change in the sense in which it circulates. What actually happens is that it crosses this space from right to left, whereas previously it was circulating from left to right.

Likewise, the cooling fluid F2 which enters the condenser via an inlet pipe (not depicted) situated at the lower part of the exchanger, circulates from left to right in the flat spaces lying between two successive plates. It passes from a space lying between two plates to the next space, these spaces alternating with spaces provided for the fluid F1 via annular ducts similar to the ducts 70 or 76 mentioned earlier. Having arrived in the space between the plates 2*e* and 2*f*, as depicted schematically by the arrow 80, the fluid F2 enters the annular duct 82, as depicted schematically by the arrow 84, and changes the sense in which it circulates. In the upper part of the condenser, it circulates from right to left, whereas it was circulating from left to right in the lower part. This then produces a second circulating pass for the fluid F2 also.

It is noted thus that the condenser of the invention has three types of plate which differ as far as the number of communication passages are concerned. The end plates, such as the plate 6, have just two communication passages, the first for letting one of the fluids in, the second for letting the other fluid out. The main-section plates, such as the plate 2*f*, have four communication passages. Two of these passages are devoted to the first fluid F1, while the other two passages are devoted to the fluid F2. The plates situated just before the end plate 6, such as the plate 2*a*, have three communication passages instead of four in the case of the main-section plate. The plate 2*d*, which allows the circulation passes of the two fluids to be achieved, has just two communication passages. This is because by omitting two of the four communication passages, dividing partitions are produced which allow the sense in which the fluid circulates to be changed. The plates 2*c* and 2*e*, adjacent to the plate 2*d*, have three communication passages, instead of four in the case of the main-section plates. There are thus three types of plate. The two end plates and the plate 2*d* have just two passages. The plates adjacent to the end plates and to the plate 2*d* have three passages, while the main-section plates of the condenser have four.

Figure 14:
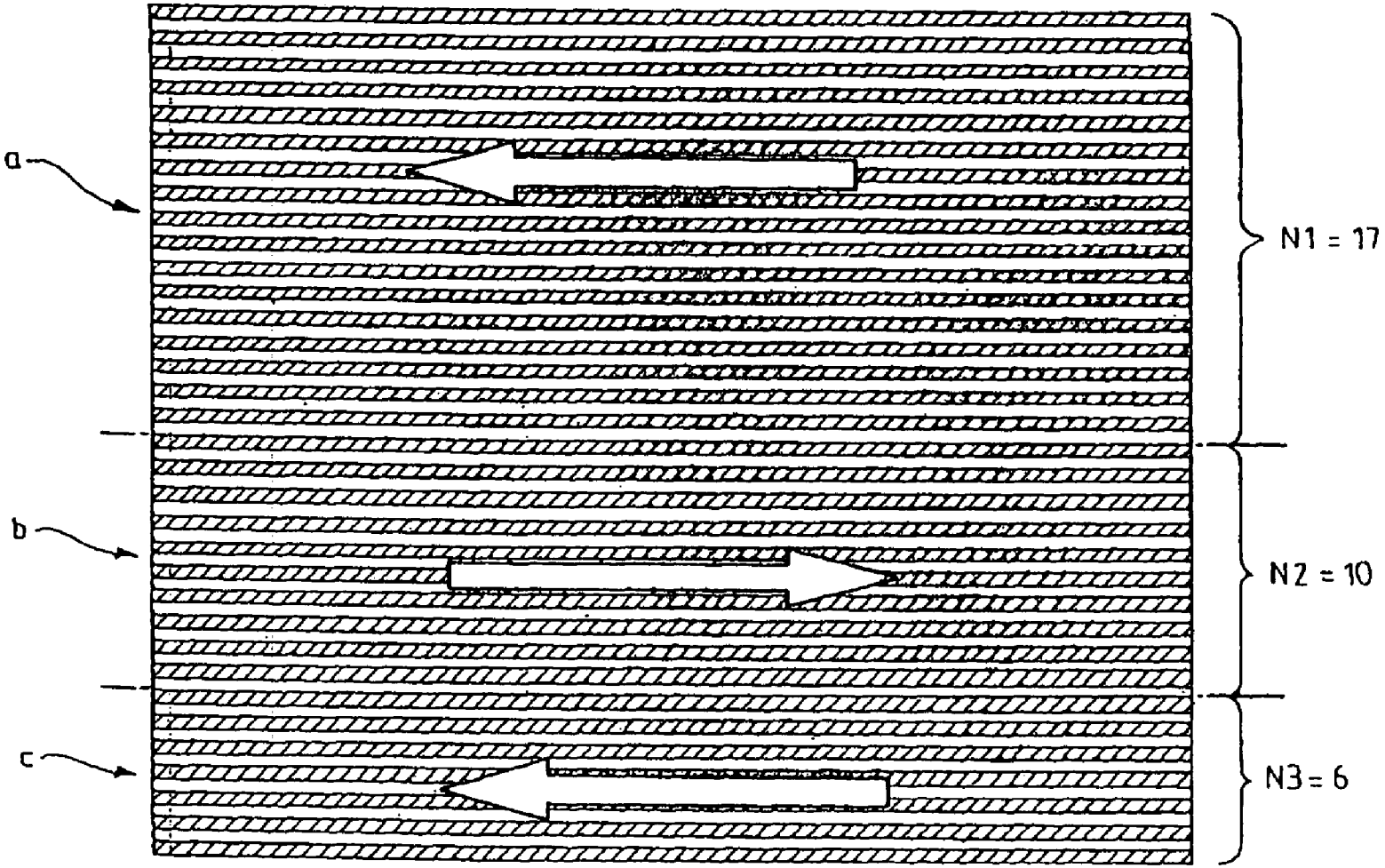
FIG. 14 depicts a three-pass condenser according to the invention.

In FIG. 14 it can be seen that the condenser according to the invention may have at least three passes "a", "b" and "c". The number of channels allocated to the inlet pass "a", that is to say the pass communicating with the inlet via which the refrigerating fluid enters the condenser, to the number of channels allocated to the outlet pass "c", that is to say the pass communicating with the outlet of the refrigerating fluid from the condenser, is between 2 and 5, the cross section of the channels being constant from one pass to the other.

In the case of a three-pass condenser one might have, by way of illustrative example, 15 to 20 channels in the inlet pass "a", 8 to 10 channels in the intermediate pass "b", and 4 to 7 channels in the outlet pass "c". In the example of FIG. 14, the numbers of the channels are, respectively, N1=17 for pass "a", N2=10 for pass "b", and N3=6 for pass "c", hence a ratio N1/N3=17/6=2.83.

Figure 6:
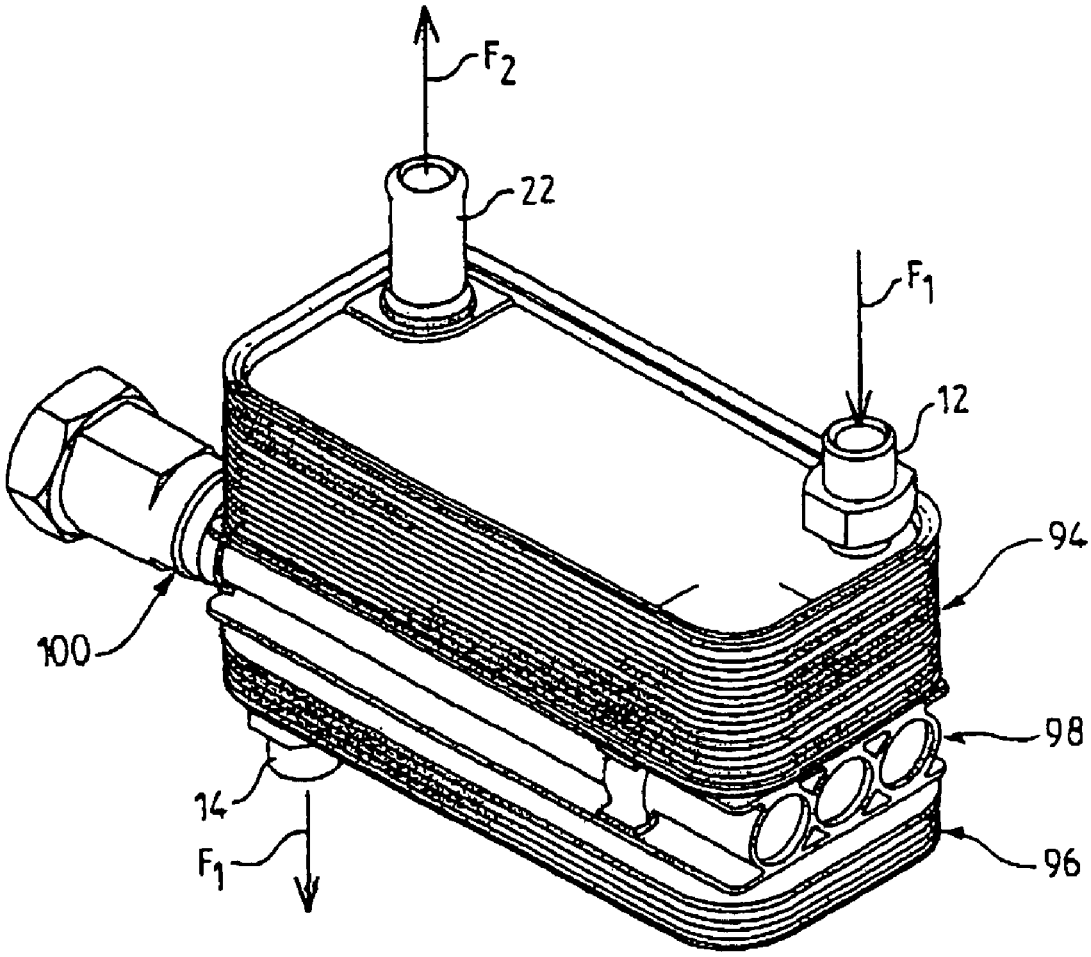
FIG. 6 is an external perspective view of the condenser according to the invention, comprising a built-in bottle.
Figure 7:
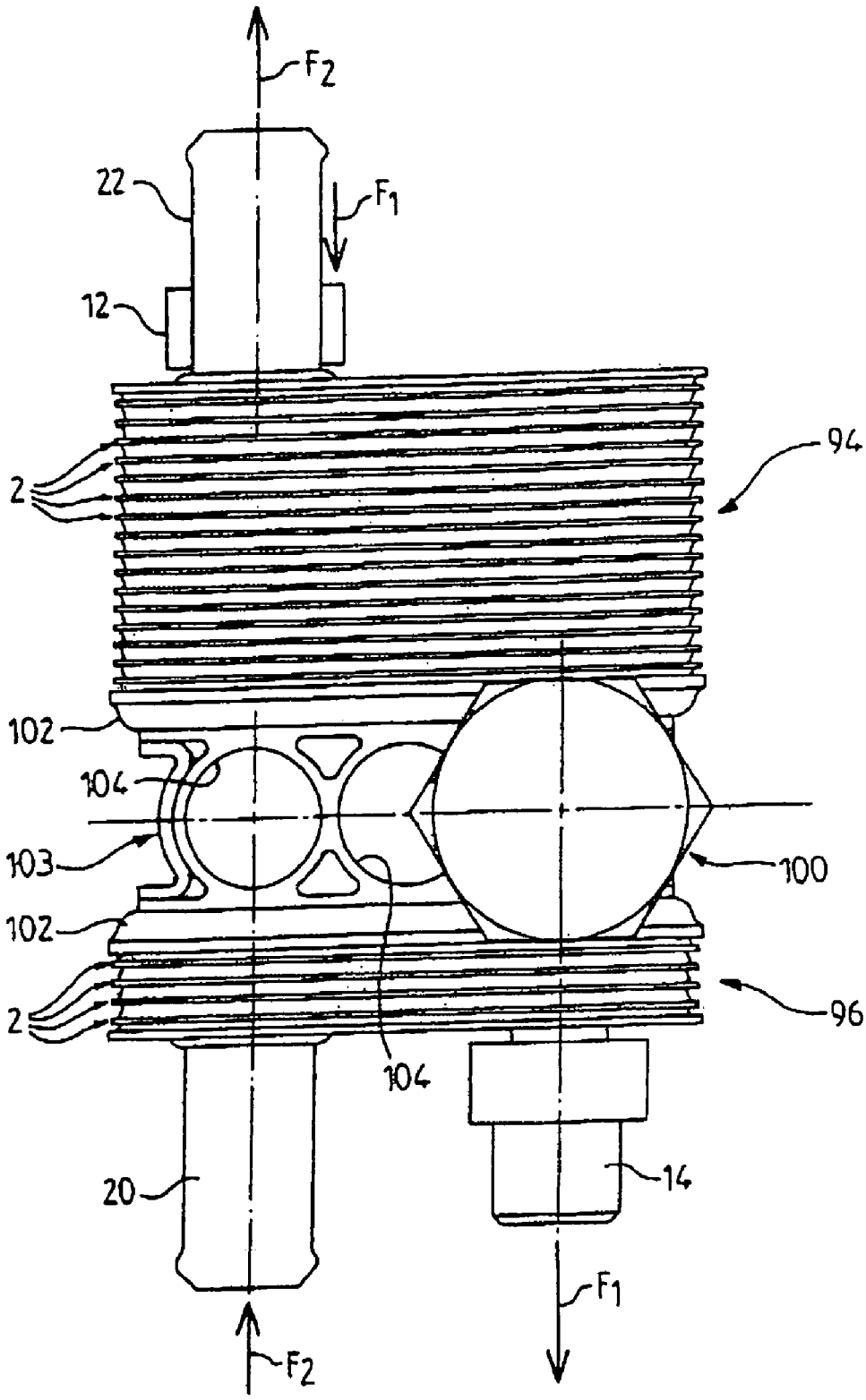
FIG. 7 is a view from the left of the condenser depicted in FIG. 6.

FIGS. 6 and 7 respectively depict a sectioned view and a view from the left of a second embodiment of a condenser according to the present invention. Its distinguishing feature is that its plates are arranged in a first series 94 and a second series 96 which series are separated from one another by a frame 98 in which a bottle 100 is housed. The first series of plates 94 is relatively larger than the second series 96. It is preferably sited at the upper part of the exchanger, while the second series is sited at the lower part.

The plates of the first series constitute a section for cooling the refrigerating fluid, and the plates of the second series constitute a section for supercooling this fluid. The bottle 100, also known as the intermediate reservoir, allows the refrigerating fluid to be filtered and water removed. It also allows variations in its volume to be compensated for and allows the liquid and gaseous phases to be separated. Its insertion between an upstream part and a downstream part 96 of the condenser makes it possible for only fluid in the liquid state to be circulated through the supercooling section. The refrigerating fluid is thus cooled below its liquid-gas equilibrium temperature, thus improving the performance of the condenser and making it relatively independent of the amount of fluid contained within the air-conditioning circuit.

The refrigerating fluid and the cooling fluid may be circulated in one or more passes through the cooling section 94, and through the supercooling section 16. The refrigerating fluid F1 enters the cooling section 94 via the inlet pipe 12 situated in the upper part of the condenser. It passes through the cooling section, in one or more passes, then passes into the bottle 100, in which it is filtered and dehydrated, then it returns to the supercooling section 96 before leaving the exchanger via the outlet pipe 14.

The cooling fluid F2 flows countercurrent with respect to the refrigerating fluid. It enters the lower part of the condenser, into the supercooling section 96, via the inlet pipe 20 (see FIG. 7). It passes through the supercooling section 96 then enters the cooling section 94 directly before reemerging from the condenser via the outlet pipe 22. As can be seen more particularly in FIG. 7, the frame 98 has two sole plates 102 and a central part 103 in which there are formed three cylindrical bores 104 which constitute the bottle. One of these bores, the right-hand one in FIG. 7, houses a filter and desiccating salts. The plates in the first series 94 and in the second series 96 rest against the sole plates 102 of the frame 98. It will also be noted that, in this example, their concave faces face in opposite directions.

Figure 8:
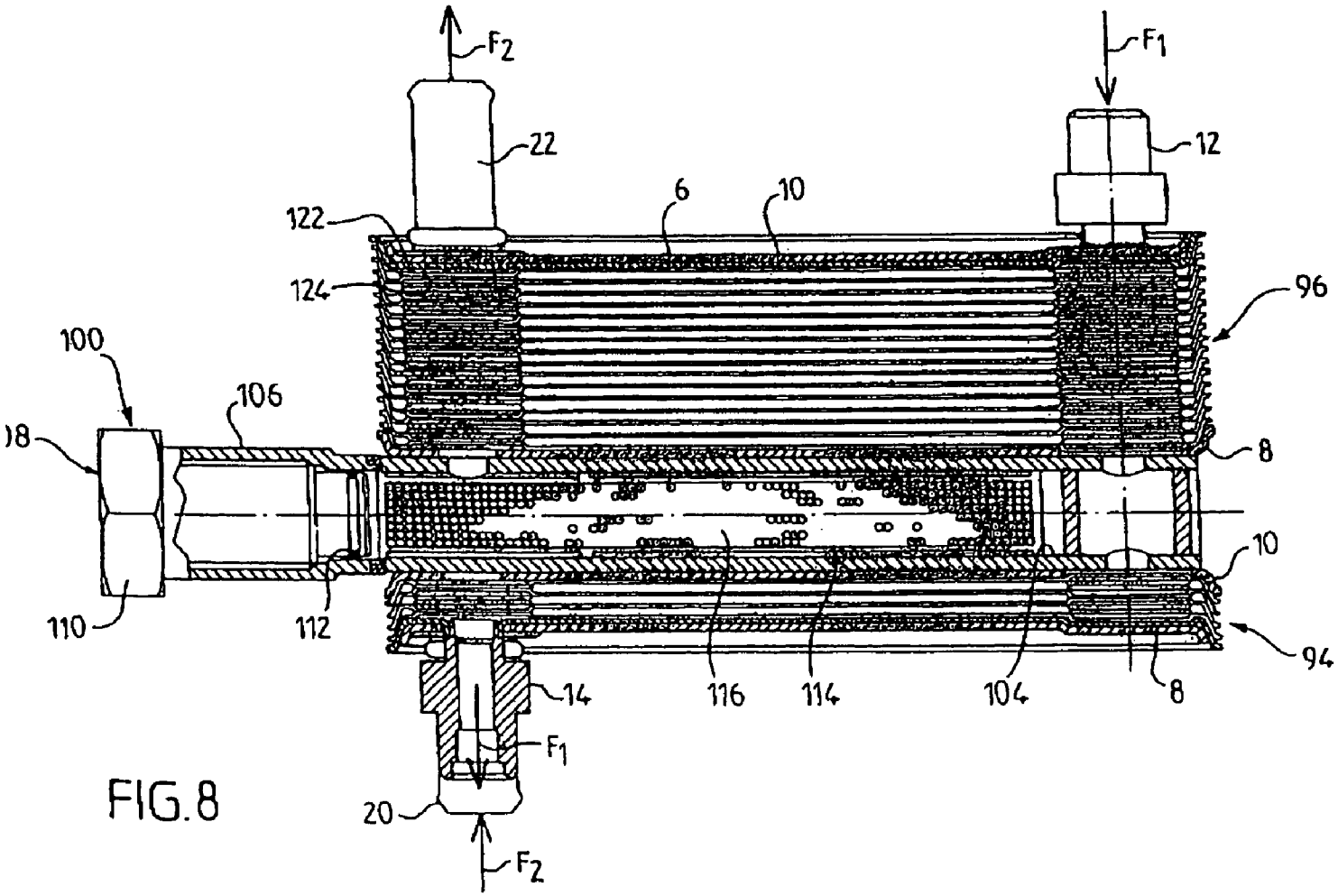
FIG. 8 is a view in cross section of the condenser depicted in FIGS. 6 and 7.
Figure 9:
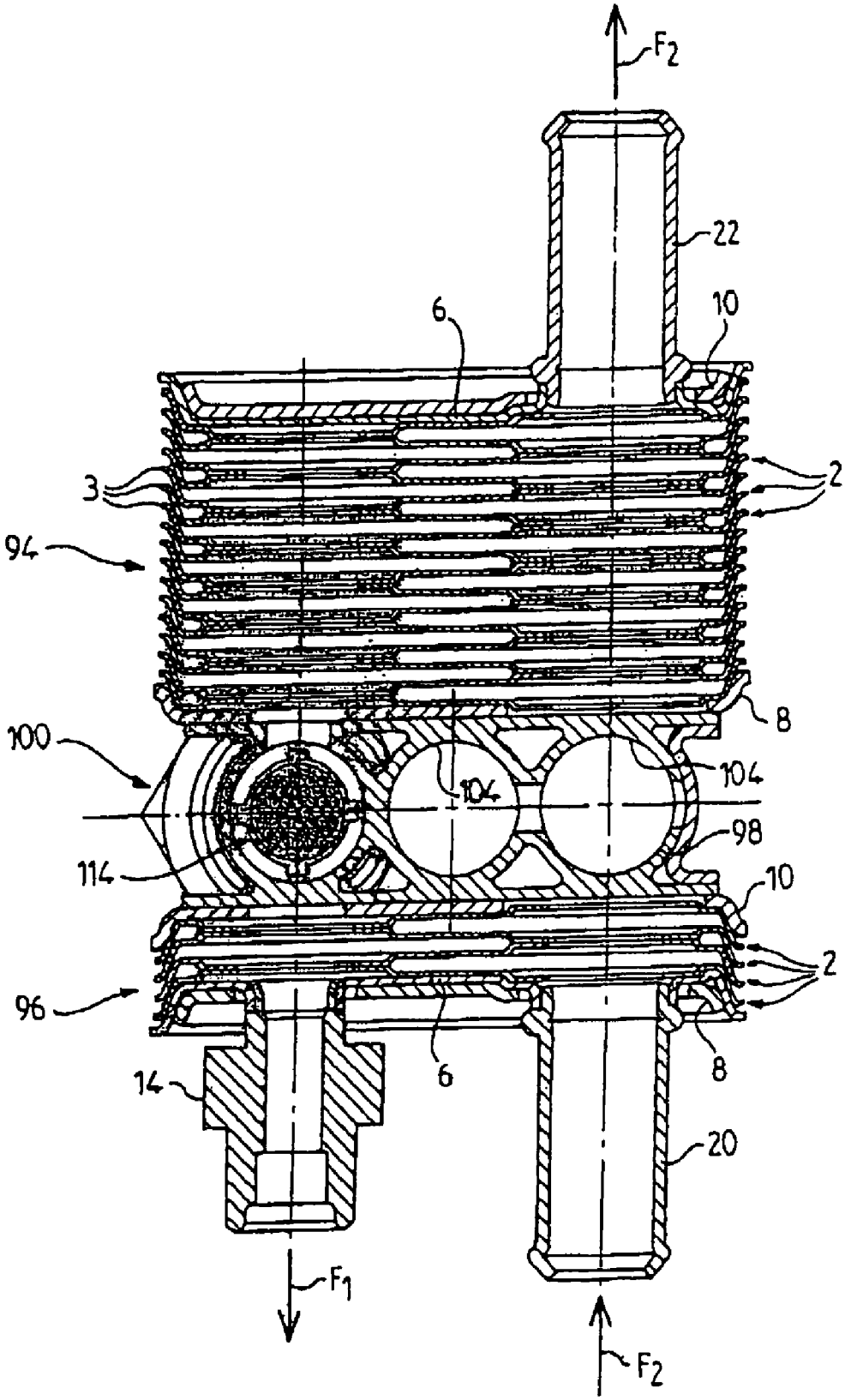
FIG. 9 is a view in section on a plane passing through the longitudinal axis of the bottle of the condenser of FIGS. 6 to 8.

FIGS. 8 and 9 respectively depict a view of the condenser in longitudinal section passing through the longitudinal axis of the part of the bottle 100 that contains the filter and the desiccating salts, and a cross section through this same exchanger. The corresponding cylindrical bore 104 is extended by a cylindrical part 106 projecting from the condenser. This cylindrical part houses a stopper 108 with a hexagonal head 110 which plugs the bottle. The stopper 108 is fitted with an O-ring seal 112. An elongate cylindrical cartridge 114 is housed inside the cylindrical bore 104. It contains the desiccant 116 that dehydrates and filters the refrigerating fluid F1.

FIG. 9 provides an appreciation of the special shape of the plates 2 of the condenser. Each plate has a flat-bottomed half-bowl 122 through which a passage orifice 124 passes. When the plates of the exchanger are stacked up, the flat bottoms of the bowls come into contact with one another. During the exchanger brazing operation, they are assembled together in a sealed manner. This then advantageously produces annular ducts that allow the refrigerating fluid F1 and the cooling fluid F2 to circulate from one passage channel to another without having to use additional components situated between the plates. Of course, as an alternative form of embodiment, one plate in every two could be flat, the bowl formed in the adjacent plate having a depth corresponding to the full separation between two successive plates.

Figure 10:
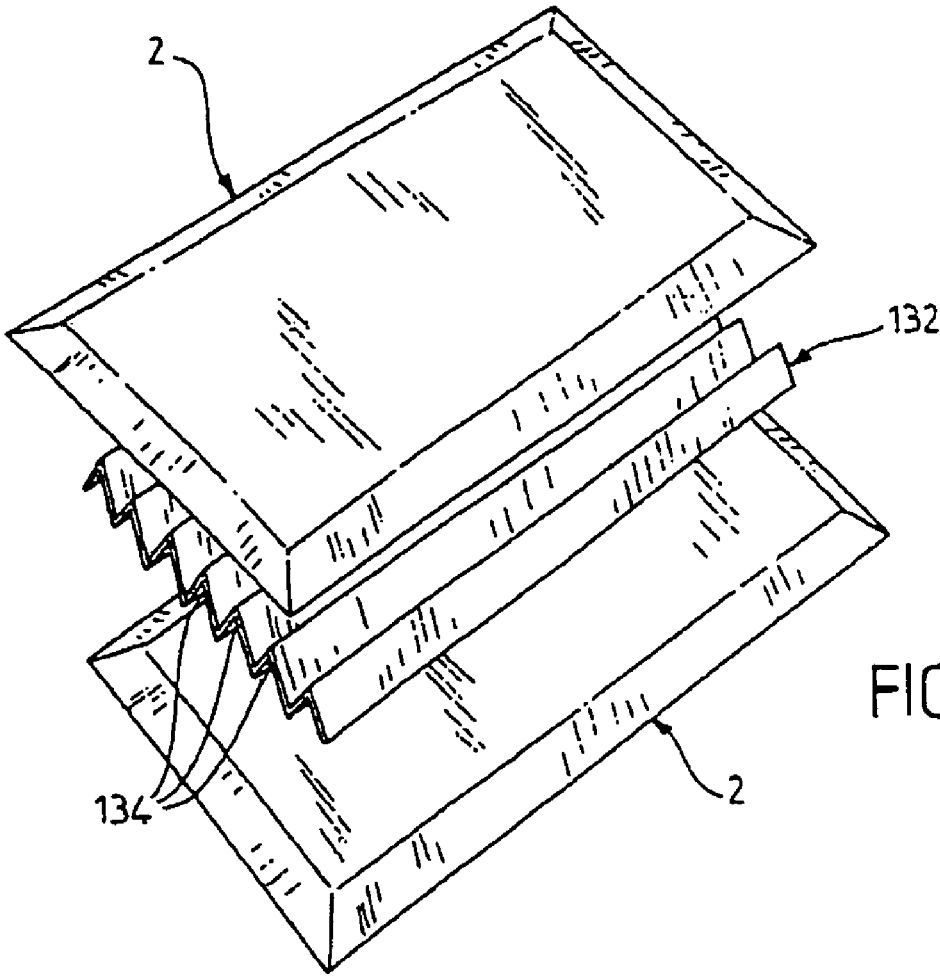
FIG. 10 depicts a first embodiment of a turbulence generator inserted between the plates.

Furthermore, according to the invention, turbulence generators (also known as turbulators) intended to improve the exchange of heat may be arranged between the plates. FIG. 10 depicts a first alternative form of embodiment of a turbulence generator 132. It consists of pressed sheet metal shaped to exhibit straight corrugations 134 arranged, for example, in the lengthwise direction of the plates. In this case, the plates 2 have a generally flat bottom.

Figure 11:
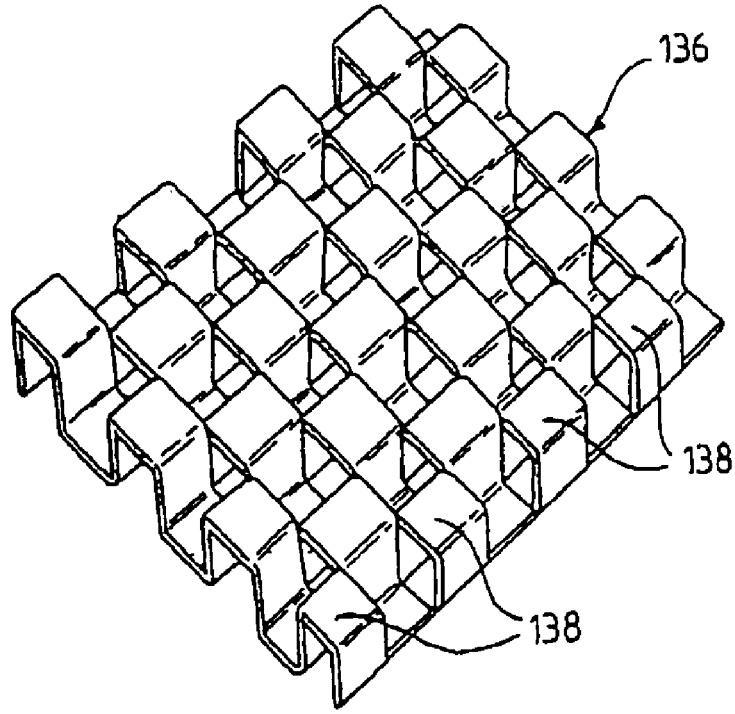
FIG. 11 depicts another embodiment of a turbulence generator inserted between the plates.

FIG. 11 depicts another embodiment of a turbulence generator 136. It comprises pressings 138 exhibiting the overall shape of a square tooth wave form. This square tooth wave form is arranged as two series of teeth offset from one another. Such a turbulence generator 136 is located between plates 2 which also have a generally flat bottom.

The turbulence generators 132 and 136 depicted in FIGS. 10 and 11 entail the manufacture of an additional component and its interposition between the plates. It is possible to omit this additional component by making the turbulence generators in the form of reliefs formed on the plates themselves and obtained by a pressing operation.

Figure 12:
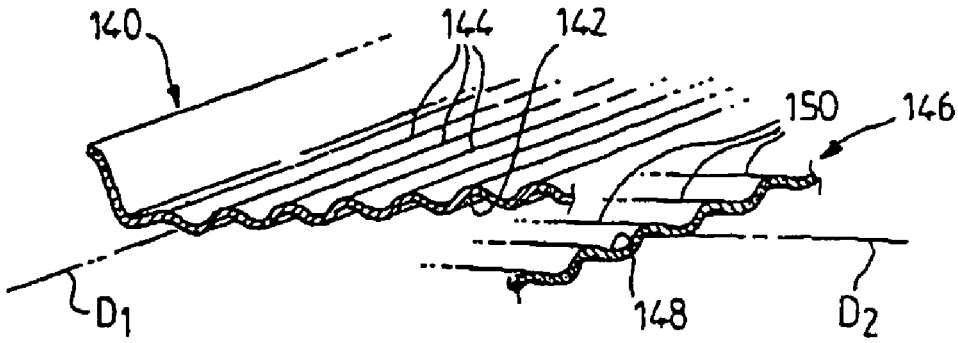
FIG. 12 depicts straight corrugated turbulence generators formed from reliefs formed in the plates.

Thus, in FIG. 12, the condenser comprises first plates 140 each having a bottom 142 with corrugations 144 defined by generatrices running in a first direction D1 and second plates 146 arranged in alternation with the first plates 140 and each exhibiting a bottom 148 having corrugations 150 defined by generatrices running in a second direction D2 which is more or less at right angles to the first direction D1. The respective corrugations in the plate allow the channels to be given a special three-dimensional structure which encourages turbulent flow of the fluid F1 and of the fluid F2 and, as a result, good heat exchange between the two. This also makes it possible to dispense with turbulence generators inserted between the plates.

Figure 13:
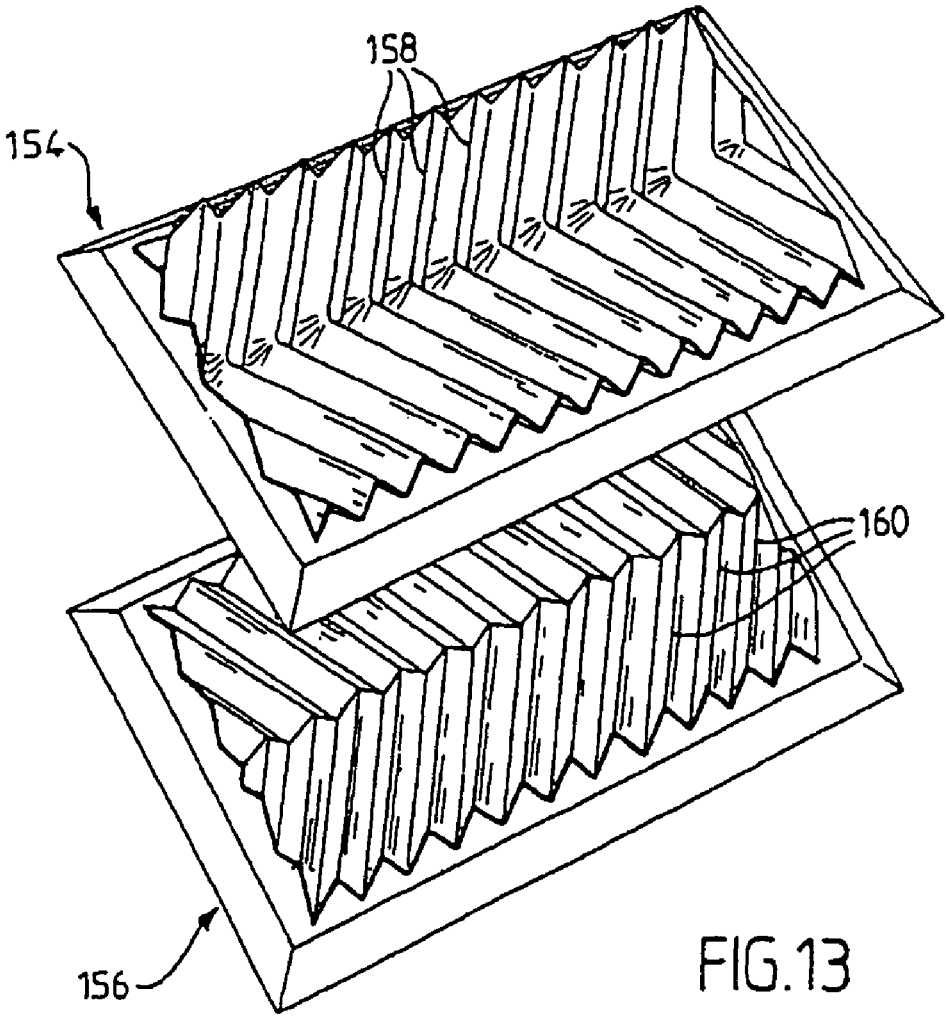
FIG. 13 depicts turbulence generators in the form of V-shaped baffles formed from reliefs formed in the plates.

FIG. 13 depicts an alternative form of embodiment of the turbulence generators of FIG. 12. The exchanger comprises a first series of plates 154 and a second series of plates 156, these respectively comprising corrugations 158 and 160 in the form of V-shaped baffles. These corrugations also define a three-dimensional structure for the fluid flow channels and this encourages turbulent flow and good exchange of heat between the two.

The invention claimed is:

1. A motor vehicle condenser comprising:

a multitude of stacked main-section plates having separate internal flow channels for refrigerating fluid and for cooling fluid, wherein the main-section plates are assembled to delimit alternating first flow channels for refrigerating fluid and second flow channels for cooling fluid and are assembled in groups or sub groups of plates such that the groups or subgroups form at least two fluid passes for each of the refrigerating and cooling fluids, wherein the main-section plates define an inlet for each of the flow channels, respectively, and an outlet for each of the flow channels, respectively, with the inlet and the outlet of each flow channel spaced from each other and with one of the fluid passes defined in one direction from the inlet to the outlet of one of the respective flow channels, wherein the plates further comprise communication passages to allow refrigerating and cooling fluid to pass from one flow channel to another and annular ducts facing the communication passages, wherein the annular ducts alternately face the communication passages in such a way that the refrigerating and cooling fluid are prevented from mixing with one another, and wherein the condenser comprises at least one condenser inlet and one condenser outlet for refrigerating fluid and at least one inlet pass (a) over the refrigerating fluid communicating with said condenser inlet, and an outlet pass (c) communicating with said condenser outlet, the cross section of the passes diminishing from the inlet pass towards the outlet pass.

2. A motor vehicle condenser, as claimed in claim 1, wherein the main-section plates are equipped with two communication passages intended for the passage of the refrigerating fluid (F1) and two communication passages intended for the passage of the cooling fluid (F2).

3. A motor vehicle condenser, as claimed in claim 1, wherein the stacked plates (2) are equipped with turned-up peripheral edges (3) which are joined together in a sealed manner.

4. A motor vehicle condenser, as claimed in claim 1, wherein one refrigerating fluid communication passage or, as appropriate, one cooling fluid communication passage, is omitted in some of the main-section plates so as to determine passes for the circulation of the refrigerating fluid or, as appropriate, for the circulation of the cooling fluid.

5. A motor vehicle condenser, as claimed in claim 1, wherein the plates (2) are arranged in a first series (94) for cooling the refrigerating fluid until it condenses, and a second series (96) for cooling the refrigerating fluid below the temperature at which it condenses.

6. A motor vehicle condenser, as claimed in claim 5, wherein the condenser further comprises a bottle (100) built in between the first and second series of plates (94, 96).

7. A motor vehicle condenser, as claimed in claim 1, wherein turbulence generators (132, 136) are arranged between the plates (2).

8. A motor vehicle condenser, as claimed in claim 7, wherein the plates have reliefs (144, 150, 158, 160) which constitute the turbulence generators.

9. A motor vehicle condenser, as claimed in claim 1, wherein the hydraulic diameter of the flow channels for the fluids (F1 and F2) is between 0.1 mm and 3 mm.

10. A motor vehicle condenser, as claimed in claim 1, wherein the annular ducts comprise bowls (122) formed in the plates (2).

11. A motor vehicle cooling circuit comprising the condenser as claimed in claim 1, wherein the plates are assembled to allow for the flow of a cooling fluid (F2) comprising water from the motor vehicle engine cooling circuit.

12. An air-conditioning circuit, for the cabin of a motor vehicle, comprising an evaporator, a compressor and a condenser, in which a refrigerating fluid circulates, and wherein the condenser is in accordance with claim 1.

13. A motor vehicle condenser, as claimed in claim 10, wherein one refrigerating fluid communication passage or one cooling fluid communication passage, is omitted in some of the main-section plates so as to determine passes for the circulation of the refrigerating fluid or for the circulation of the cooling fluid.

14. A motor vehicle condenser, as claimed in claim 1, wherein each main-section plate has a longitudinal axis and has a first end and a second end spaced from each other along the longitudinal axis with the main-section plates stacked with each first end adjacent another first end and with each second end adjacent another second end and with the inlet of one flow channel defined at one of the first ends and with the outlet of that flow channel defined at one of the second ends.

15. A motor vehicle condenser, as claimed in claim 1, wherein the inlets and outlets for each of the flow channels are further defined by the main-section plates as a first inlet and a first outlet for the first flow channel and a second inlet and a second outlet for the second flow channel, and one of the at least two fluid passes for the refrigerating fluid is defined along a first direction from the first inlet to the first outlet for the first flow channel, and one of the at least two fluid passes for the cooling fluid is defined along a second direction from the second inlet to the second outlet for the second flow channel.

16. A motor vehicle condenser, as claimed in claim 1, wherein no more than one fluid pass extends in any one of the first and second flow channels.

17. A motor vehicle condenser, as claimed in claim 1, wherein one of the at least two fluid passes for the refrigerating fluid extends through one of the first flow channels and another of the at least two fluid passes for the refrigerating fluid extends through another of the first flow channels and wherein one of the at least two fluid passes for the cooling fluid extends through one of the second flow channels and another of the at least two fluid passes for the cooling fluid extends through another of the second flow channels.

18. A motor vehicle condenser comprising:

a multitude of stacked main-section plates having separate internal flow channels for refrigerating fluid and for cooling fluid, wherein the main-section plates are assembled to delimit alternating first flow channels for refrigerating fluid and second flow channels for cooling fluid and are assembled in groups or sub groups of plates such that the groups or subgroups form at least two fluid passes for each of the refrigerating and cooling fluids, and wherein the main-section plates define an inlet for each of the flow channels, respectively, and an outlet for each of the flow channels, respectively, with the inlet and the outlet of each flow channel spaced from each other and with one of the fluid passes defined in one direction from the inlet to the outlet of one of the respective flow channels, wherein the plates further comprise communication passages to allow refrigerating and cooling fluid to pass from one flow channel to another and annular ducts facing the communication passages, wherein the annular ducts alternately face the communication passages in such a way that the refrigerating and cooling fluid are prevented from mixing with one another, wherein the annular ducts comprise bowls (122) formed in the plates (2), and wherein the condenser comprises at least one condenser inlet and one condenser outlet for refrigerating fluid and at least one inlet pass (a) over the refrigerating fluid communicating with said condenser inlet, and another outlet pass (c) communicating with said condenser outlet, and the cross section of the passes diminishing from the inlet pass towards the outlet pass.

19. A motor vehicle condenser, as claimed in claim 18, wherein the main-section plates are equipped with two communication passages intended for the passage of the refrigerating fluid (F1) and two communication passages intended for the passage of the cooling fluid (F2).

20. A motor vehicle condenser, as claimed in claim 18, wherein the stacked plates (2) are equipped with turned-up peripheral edges (3) which are joined together in a sealed manner.

21. A motor vehicle condenser, as claimed in claim 18, wherein one refrigerating fluid communication passage or, as appropriate, one cooling fluid communication passage, is omitted in some of the main-section plates so as to determine passes for the circulation of the refrigerating fluid or, as appropriate, for the circulation of the cooling fluid.

22. A motor vehicle condenser, as claimed in claim 18, wherein the plates (2) are arranged in a first series (94) for cooling the refrigerating fluid until it condenses, and a second series (96) for cooling the refrigerating fluid below the temperature at which it condenses.

23. A motor vehicle condenser, as claimed in claim 22, wherein the condenser further comprises a bottle (100) built in between the first and second series of plates (94, 96).

24. A motor vehicle condenser, as claimed in claim 18, wherein turbulence generators (132, 136) are arranged between the plates (2).

25. A motor vehicle condenser, as claimed in claim 24, wherein the plates have reliefs (144, 150, 158, 160) which constitute the turbulence generators.

26. A motor vehicle condenser, as claimed in claim 18, wherein the hydraulic diameter of the flow channels for the fluids (F1 and F2) is between 0.1 mm and 3 mm.

27. A motor vehicle cooling circuit comprising the condenser as claimed in claim 18, wherein the plates are assembled to allow for the flow of a cooling fluid (F2) comprising water from the motor vehicle engine cooling circuit.

28. An air-conditioning circuit, for the cabin of a motor vehicle, comprising an evaporator, a compressor and a condenser, in which a refrigerating fluid circulates, and wherein the condenser is in accordance with claim 18.

29. A motor vehicle condenser, as claimed in claim 18, wherein each main-section plate has a longitudinal axis and has a first end and a second end spaced from each other along the longitudinal axis with the main-section plates stacked with each first end adjacent another first end and with each second end adjacent another second end and with the inlet of one flow channel defined at one of the first ends and with the outlet of that flow channel defined at one of the second ends.

30. A motor vehicle condenser, as claimed in claim 18, wherein the inlets and outlets for each of the flow channels are further defined by the main-section plates as a first inlet and a first outlet for the first flow channel and a second inlet and a second outlet for the second flow channel, and one of the at least two fluid passes for the refrigerating fluid is defined along a first direction from the first inlet to the first outlet for the first flow channel, and one of the at least two fluid passes for the cooling fluid is defined along a second direction from the second inlet to the second outlet for the second flow channel.

31. A motor vehicle condenser, as claimed in claim 18, wherein no more than one fluid pass extends in any one of the first and second flow channels.

32. A motor vehicle condenser, as claimed in claim 18, wherein one of the at least two fluid passes for the refrigerating fluid extends through one of the first flow channels and another of the at least two fluid passes for the refrigerating fluid extends through another of the first flow channels and wherein one of the at least two fluid passes for the cooling fluid extends through one of the second flow channels and another of the at least two fluid passes for the cooling fluid extends through another of the second flow channels.

* * * * *